United States Patent [19]

Röck et al.

[11] Patent Number: 4,494,803

[45] Date of Patent: Jan. 22, 1985

[54] PULL-OUT GUIDE ASSEMBLY FOR DRAWERS

[75] Inventors: Erich Röck; Josef Brunner, both of Höchst, Austria

[73] Assignee: Julius Blum Gesellschaft m.b.H., Höchst, Austria

[21] Appl. No.: 509,230

[22] Filed: Jun. 28, 1983

[30] Foreign Application Priority Data

Jul. 7, 1982 [AT] Austria ..... 2627/82

[51] Int. Cl.[3] ..... F16C 29/04

[52] U.S. Cl. ..... 308/3.8

[58] Field of Search ..... 308/3.8, 3.6, 6 R; 312/341 R, 350

[56] References Cited

U.S. PATENT DOCUMENTS 4,037,885 7/1977 Rock et al. ..... 308/3.8
4,121,876 10/1978 Ratti ..... 308/3.8
4,333,690 6/1982 Keefe et al. ..... 308/3.8
4,367,906 1/1983 Röck ..... 312/341 R

FOREIGN PATENT DOCUMENTS 262546 6/1968 Austria .
361177 2/1981 Austria .
361899 6/1981 Austria .
3203839 2/1982 Fed. Rep. of Germany .

*Primary Examiner*—Lenard A. Footland
*Attorney, Agent, or Firm*—Wenderoth, Lind & Ponack

[57] ABSTRACT

A pull-out guide assembly is positioned underneath the floor of a drawer and includes two pull-out rails, two supporting rails and two carriages in which rollers are supported between respective pull-out rail supporting rails. Each pull out rail embraces the respective supporting rail on four sides, and there are rollers with horizontal axles as well as rollers with vertical axles in each carriage. The supporting rails have both vertical and horizontal running flanges for the rollers.

2 Claims, 4 Drawing Figures

PULL-OUT GUIDE ASSEMBLY FOR DRAWERS

FIELD AND BACKGROUND OF THE INVENTION

The invention relates to a pull-out guide assembly for drawers or the like, and including on each side of the drawer a pull-out rail attached to the side of the drawer, a supporting rail attached to the side of the body of the respective article of furniture, and an intermediately arranged carriage in which load-transmitting disk-shaped or cylindrical rollers rotating about axles defined by holding means of the carriage are mounted. Preferably, the supporting rails as well as the pull-out rails are provided with inclined portions at the ends of respective running flanges so that the drawer is drawn into its closed position by its own weight.

DESCRIPTION OF THE PRIOR ART

Two kinds of pull-out guide assemblies are known in the art and in which rollers are not directly fixed to one of the rails, but are arranged in a separate carriage. The best known are the so-called roller drawers in which load-transmission takes place between the rails by means of steel balls which are held in a carriage designed as a ball cage.

Such pull-out guides are very precise, i.e. they ensure excellent running of the drawer and at the same time a perfect fit of the drawer in the body, i.e. the drawer is laterally as well as vertically guided in a very stable manner. Such pull-out guides are particularly used in articles of furniture of superior quality, e.g. office furniture.

It is a disadvantage of these pull-out guide assemblies that the rails must have complicated profiles to define the rolling paths of the balls. It is a further disadvantage that drawers provided with such pull-out guide assemblies are not automatically closed, and it is difficult to provide means to this end in view of the complicated profiles. That is, a drawer which has not been entirely closed is not automatically fully pulled into the body and remains open.

The other kind of pull-out guide assembly has only previously been put on the market and has cylindrical rollers. These rollers are of the same kind as those which are usually directly mounted at the rails. These pull-out guide assemblies also have good running properties, and they can easily be provided with means for automatically closing the drawer, but their stability, particularly the lateral stability of the assembly, has not proved fully satisfactory. In the past, such pull-out guide assemblies have therefore been provided with lateral slide members. This solution is not fully satisfactory, either, as it permits only lateral alignment of the drawer in the closed position, but does not improve the stability of the drawer when being pulled out.

SUMMARY OF THE INVENTION

It is the object of the invention to provide a pull-out guide assembly of the afore-described kind which has the advantages of ball guide means with respect to the stability of the pull-out guide assembly, as well as the advantages of a pull-out guide assembly with cylindrical rollers, i.e. simple rail profiles and means for automatically closing the drawer.

According to the invention this is achieved by providing each pull-out rail with a portion of rectangular cross-section receiving the respective carriage, substantially half of such portion being open at the side directed towards the furniture side wall. Further, each supporting rail is provided with a portion having a Z-shaped profile extending into the pull-out rail and into the carriage. This portion with a Z-shaped profile has two vertical flanges and a horizontal center flange. Below and above such center flange forming a running flange are arranged rollers with vertical axes of rotation, such rollers running at both sides of the portion having the Z-shaped profile between the vertical flanges of such portion and vertical flanges of the pull-out rail. The carriage has a groove with a vertical depth receiving the external vertical flange of the supporting rail.

In a manner known per se, the supporting rails at their rear sides and the pull-out rails at their front sides advantageously are provided with stops for the carriage. A particularly compact embodiment of the invention provides that the portions of the pull-out rails of rectangular cross-section are in the mounted position below the bottom of the drawer.

BRIEF DESCRIPTION OF THE DRAWINGS

In the following an embodiment of the invention will be described in more detail with reference to the attached drawings, in which.

DESCRIPTION OF THE PREFERRED EMBODIMENT

Figure 1:
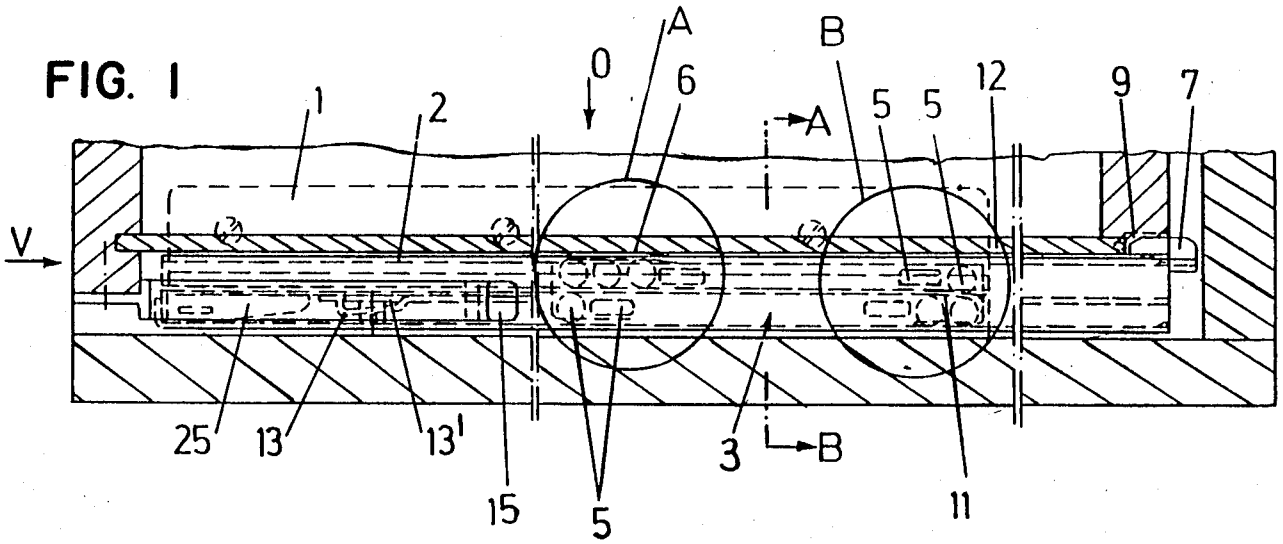
FIG. 1 is a side view of one side of a pull-out guide assembly, the drawer being in the inserted position.

Only one half of the pull-out guide assembly is shown in the drawings. It is obvious that the other side is a mirror image. In the following description reference will be made to one side only for the sake of simplification.

The pull-out guide assembly according to the invention comprises on each side a supporting rail 1 on the side of the body of an article of furniture 2 a pull-out rail on the side of the drawer, a carriage 3 being mounted between rails 1 and 2. Rollers 5 are arranged in the carriage 3, some of the rollers having horizontal axes of rotation and serving for the actual load-transmission of the drawer. Other of rollers 5 have vertical axes of rotation and are provided for lateral stabilization of the pull-out guide assembly and of the drawer.

Figure 2:
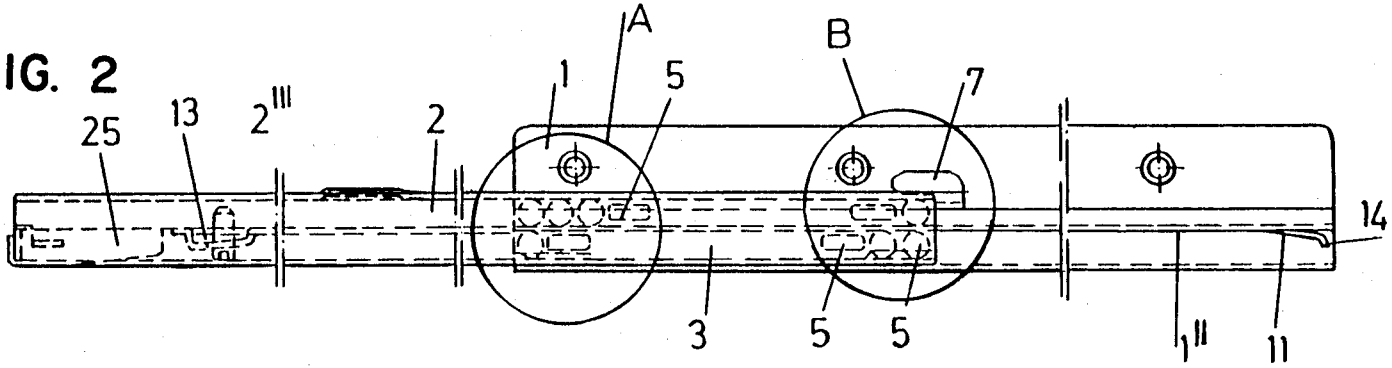
FIG. 2 is a side view of the pull-out assembly shown in the pulled-out position and the drawer not being illustrated.

As can be seen from FIGS. 1 and 2, the rollers 5 in the carriage 3 are combined and arranged in a front group A and in a rear group B. When the pull-out guide is in the inserted position, as shown in FIG. 1, the front group A is exactly below an angular portion 6 of a running flange 2' of the pull-out rail, and the rear group B embraces an angular portion 11 at a running flange 1' of the supporting rail 1. The angular portions 6 and 11 form the closing means of the pull-out guide assembly, i.e. a drawer which has not been fully closed or inserted but pushed in such that the angular portions 6 and 11 are positioned on the foremost rollers 5 is automatically moved back into the furniture body due to its own weight.

Figure 4:
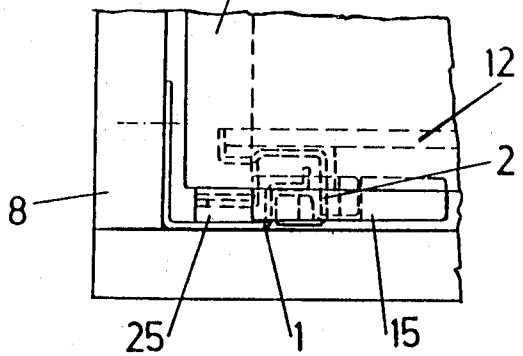
FIG. 4 is an end view in the direction V of FIG. 1.
Figure 3:
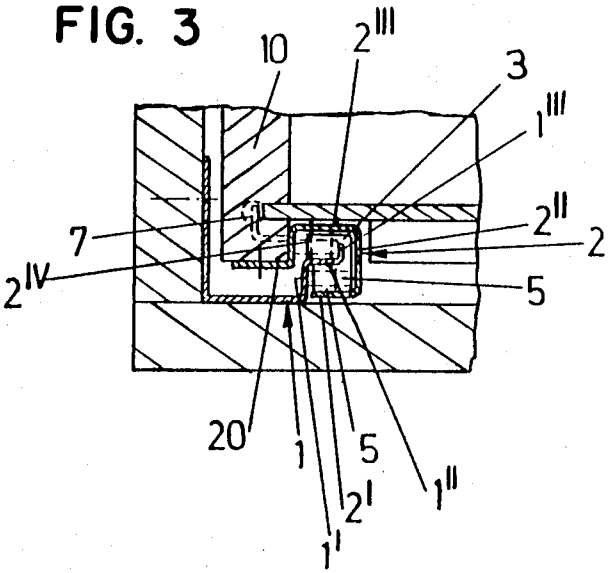
FIG. 3 is a sectional view along line A—B of FIG. 1.

As can particularly be seen in FIGS. 3 and 4, the pull-out rail 2 is provided with a portion of rectangular cross-section receiving the carriage 3. Such rectangular portion is formed by flanges 2', 2'',2''' and 2$^{IV}$ of the pull-out rail 2.

A portion of the supporting rail 1 having a Z-shaped profile extends into such rectangular portion and into the carriage 3. Such Z-shaped portion is formed by flanges 1', 1'' and 1''' of the supporting rail 1. The center flange 1'' of this portion is a horizontal flange and forms the actual running flange of the supporting rail 1. The rollers 5 of the carriage 3 are arranged below as well as above flange 1'', i.e. rollers 5 with vertical axes of rotation as well as with horizontal axes of rotation.

To obtain particularly good lateral guiding of the pull-out guide assembly, rollers 5 with vertical axes of rotation are arranged above the horizontal flange 1'' between the external or outer vertical flange 1''' of the supporting rail 1 and the vertical flange 2$^{IV}$ of the pull-out rail 2, and rollers 5 with vertical axes of rotation are arranged below the horizontal flange 1'' between the inner vertical flange 1' of the supporting rail 1 and the vertical flange 2'' of the pull-out rail 2. Together with the rollers 5 having horizontal axes of rotation, which are arranged between the horizontal flange 2''' of the pull-out rail 2 and the running flange 1'' of the supporting rail 1, as well as with those which are arranged below the running flange 1'' and above the horizontal flange 2' of the pull-out rails 2, the rail 1,2 are compactly guided on all sides, i.e. each half of the pull-out guide assembly forms a closed unit supported on all sides.

The pull-out guide assembly according to the invention is advantageously arranged below the drawer bottom 12. The pull-out rail 2 has a fastening flange 20 which is fixed at or in the drawer side wall 10. The supporting rail 1 is advantageously fastened to the body side wall 8. The front of pull-out guide 2 is provided with a plastic member 25 which is, on the one hand, a support for the inserted drawer and, on the other side, also a front stop for the carriage 3. The rear stop at the supporting rail 1 is formed by an angular end portion 14 of the running flange 1'' of the supporting rail 1.

While the supporting rail 1 is conventionally screwed to the body side wall 8, the pull-out rail has at its rear side a hook member 7 which is insertable into a hole in the rear wall of the drawer. At its front the pull-out rail is held with a latch member 15 which is fastened to the drawer 4, projects with a nose into an aperture of the pull-out rail 2 and embraces a punched flange of the drawer.

At its front the pull-out rail 2 further has a disk 13 with a helical support rim. By turning the disk 13 the drawer which lies directly on disk 13 can be lifted from the pull-out rail 2, thus permitting a vertical adjustment of the drawer.

What is claimed is:

1. A pull-out guide assembly for use on each of opposite sides of a drawer or the like in an article of furniture of the type wherein the drawer or the like is slidably insertable into and removable from a furniture body, said assembly comprising:

a pull-out rail to be fastened at a side of the drawer;

a supporting rail to be fastened at a side of the body;

an intermediate carriage arranged between said rails and supporting load-transmitting disk or cylindrical shaped rollers;

said rails having respective running flanges having ends with inclined portions for drawing the drawer into the body;

said pull-out rail having a portion of rectangular cross-section receiving said carriage, said portion of rectangular cross-section being defined by two horizontal flanges and two vertical flanges, approximately half of said portion of rectangular cross-section being open at a side thereof directed toward a side wall of the body;

said supporting rail having a portion with a Z-shaped profile extending into said pull-out rail and into said carriage, said portion having said Z-shaped profile including a horizontal flange defining said running flange of said supporting rail and inner and outer vertical flanges extending from respective opposite ends of said horizontal flange thereof;

said rollers including first rollers having vertical axes of rotation and arranged above said horizontal flange of said supporting rail and running between said outer vertical flange of said supporting rail and a first said vertical flange of said pull-out rail;

said rollers further including second rollers having vertical axes of rotation and arranged below said horizontal flange of said supporting rail and running between said inner vertical flange of said supporting rail and a second said vertical flange of said pull-out rail; and said carriage having a groove with a vertical depth for receiving said outer vertical flange of said supporting rail.

2. An assembly as claimed in claim 1, wherein said portion of rectangular cross-section of said pull-out rail in the mounted position is beneath the bottom of the drawer.

* * * * *